United States Patent [19]

Itoh et al.

[11] 4,353,125

[45] Oct. 5, 1982

[54] ELECTROMAGNETIC PICKUP CARTRIDGE

[75] Inventors: Masashi Itoh, Settsu; Kazuo Teramae, Moriguchi, both of Japan

[73] Assignee: Matsushita Electric Industrial Co., Ltd., Osaka, Japan

[21] Appl. No.: 208,297

[22] Filed: Nov. 19, 1980

[30] Foreign Application Priority Data

Nov. 29, 1979 [JP] Japan ..... 54-155373

[51] Int. Cl.[3] ..... H04R 11/12

[52] U.S. Cl. ..... 369/136; 369/146; 369/149

[58] Field of Search ..... 369/149, 148, 147, 146, 369/136; 360/126

[56] References Cited

U.S. PATENT DOCUMENTS 3,077,522 2/1963 Gunter ..... 369/149

3,356,795 12/1967 Shaper ..... 369/148

4,140,886 2/1979 Itoh ..... 369/149

4,251,695 2/1981 Ono ..... 369/147

*Primary Examiner*—Alan Faber

*Attorney, Agent, or Firm*—Burgess, Ryan and Wayne

[57] ABSTRACT

A stereophonic electromagnetic pickup cartridge in which each of the right- and left-channel yokes is formed by folding a thin strip of a magnetic material over itself many times like pleats into a U-shape; coils are mounted on the yokes; the bases of the yokes are crossed so that the bases of the yokes are respectively disposed along the lines which are crossed by 90° respectively with the axes of the maximum sensitivity of the right- and left-channels are formed; and an armature is disposed at the open ends of the yokes. Mass production at less costs of high-quality yokes with minimum eddy current loss becomes possible.

7 Claims, 11 Drawing Figures

ELECTROMAGNETIC PICKUP CARTRIDGE

BACKGROUND OF THE INVENTION

The present invention relates to an electromagnetic pickup cartridge such as a moving-magnet or moving-iron pickup cartridge and has for its object to provide an electromagnetic cartridge which can be assembled in a simple manner and which can reduce mechanical distortions to a minimum.

In the reproduction of the 45/45-degree stereophonic records, the moving-magnet pickup cartridges have been widely used because of their stabilized operation and the ease with which a stylus is replaced. The moving-iron pickup cartridges are also used. In order to improve performances of such electromagnetic pickup cartridges such as moving-magnet and moving-iron pickup cartridges, the improvements of a moving or vibration system consisting of a stylus, a cantilever or a stylus bar, an armature and a damper are essential so that the mechanical vibration of the stylus may be correctly transmitted. Recently new materials have been used in the moving or vibration systems so that the pickup characteristics have been considerably improved. However, further improvements of the pickup cartridges cannot be attained without improvements in the generators comprising the two yokes and two coils mounted on the yokes for converting the mechanical vibration transmitted through the moving or vibrating system into the electrical signal.

SUMMARY OF THE INVENTION

One of the objects of the present invention is to provide an electromagnetic stereophonic pickup cartridge which shows excellent performance and can reduce eddy current loss to a minimum.

Another object of the present invention is to provide an electromagnetic stereophonic pickup cartridge adapted for the mass production at less costs.

According to the present invention, each of the right- and left-channel yokes is provided by folding a thin strip of a magnetic material over itself many times like pleats into a U-shape, and coils are mounted on the yokes, respectively. The yokes are assembled in such a way that the base portions of the yokes cross each other, the axes of the maximum sensitivity being established at this crossing point. An armature is so placed as to be surrounded with the yokes adjacent to the open ends thereof.

According to one embodiment of the present invention, a yoke consists of a laminated yoke part or a laminated block with a recess and a laminated yoke, one leg of which is inserted into the recess of the laminated yoke part or the laminated block. Therefore, a coil can be mounted on one leg of the laminated yoke before the latter is combined with the laminated yoke part or the laminated block. As a result, the productivity of the electromagnetic cartridges can be much improved.

DETAILED DESCRIPTION OF THE PRIOR ART

Figure 1:
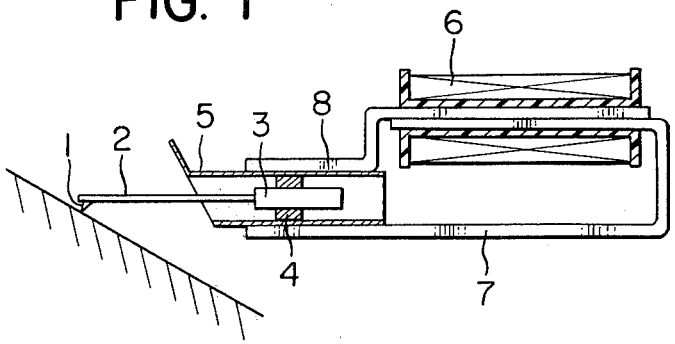
FIG. 1 PRIOR ART
FIG. 1 is a sectional view in elevation of a prior art electromagnetic pickup cartridge.

FIG. 1 shows a prior art electromagnetic pickup cartridge only with the parts for reproduction of one channel. The cartridge has a stylus tip securely fixed at the leading end of a cantilever 2 extended from a magnet 3. The magnet 3 is supported with dampers 4 in a sleeve 5 which in turn is mounted between yoke parts 7 and 8. A coil 6 is mounted on the yoke parts 7 and 8. The mechanical signal reproduced from the disk is transmitted from the stylus tip 1 to the magnetic circuit consisting of the coil 6 and the yoke parts 7 and 8. The system for the reproduction of the other channel is similar to that described above.

Figure 2:
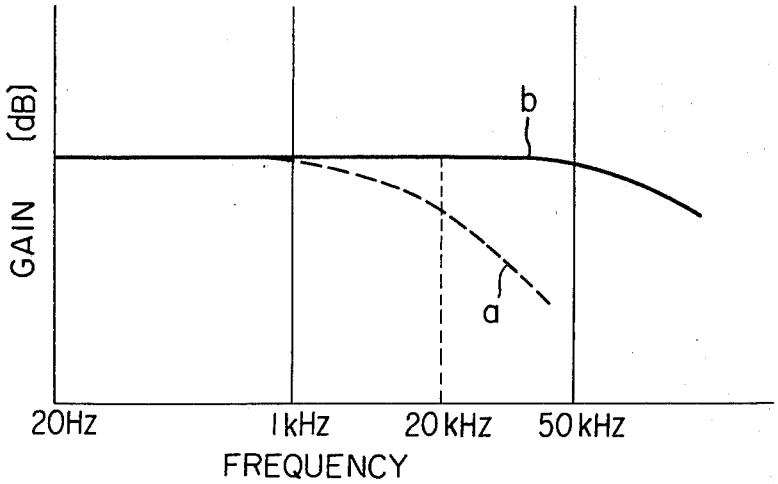
FIG. 2 PRIOR ART
FIG. 2 shows the characteristic curves thereof.

The yoke parts 7 and 8 are made of permalloy strips about 0.35 mm in thickness. Therefore, magnetic loss results mainly due to the eddy current as indicated by the curve a in FIG. 2; that is, a considerable degree of attenuation is observed in the magnetic circuit consisting only of the yoke parts 7 and 8 beyond the frequency higher than 1 kHz. In order to overcome this problem, laminations of thin permalloy strips have been long used to construct the yokes. As indicated by the curve b in FIG. 2, with the laminated yokes, there may be provided a magnetic circuit whose frequency response is flat up to the upper limit of about 20 kHz of the audible range. However, two coils must be mounted on the yokes and the dimensions or sizes of the yokes are limited, so that thin laminated strips must be very narrow in width. In addition, the strips to be laminated must be magnetically tempered and then laminated in such a way that they are free from any mechanical distortion in order to ensure the desired magnetic and other characteristics. Thus, the fabrication of the laminated yokes is very difficult and, therefore, the costs become expensive. In short, the reason why very narrow laminated yokes must be used is that the strips must be laminated within the coils.

DESCRIPTION OF THE PREFERRED EMBODIMENTS

Figure 3:
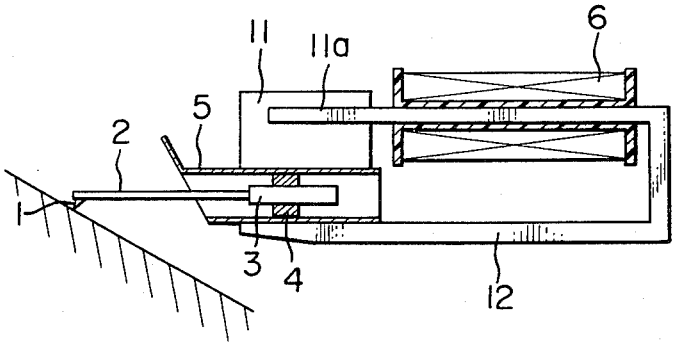
FIG. 3 is a sectional view in elevation of a first embodiment of an electromagnetic pickup cartridge in accordance with the present invention.
Figure 4:
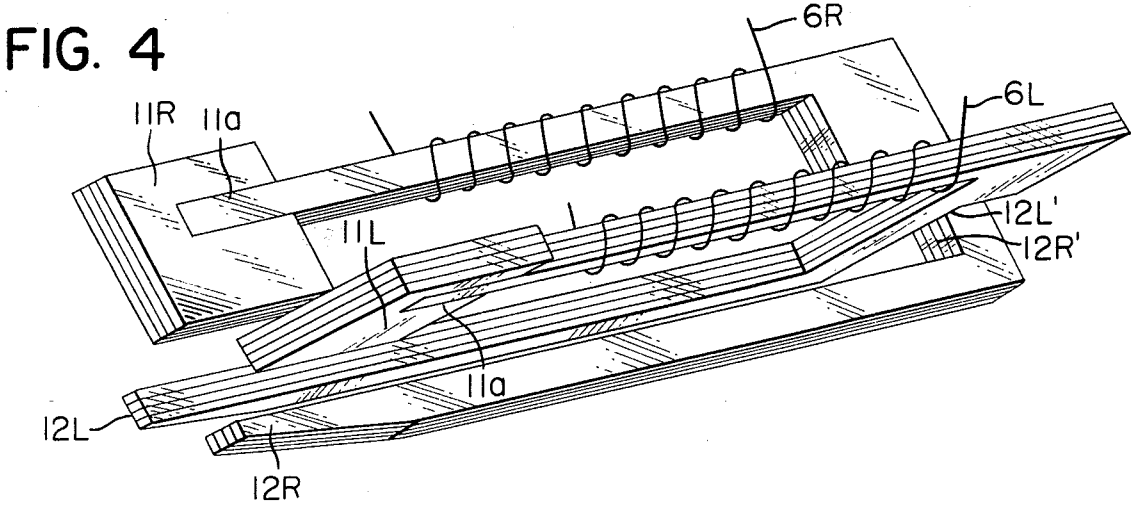
FIG. 4 shows the generator thereof, on enlarged scale.

First Embodiment, FIGS. 3 and 4

The first embodiment shown in FIG. 3 is substantially similar in construction to the prior art pickup cartridge shown in FIG. 1 except that laminated yokes 11 and 12 are used. The laminated yoke or block 11 has a U-shaped recess 11*a* into which is inserted the end of one leg of the laminated yoke 12. Since the laminated yokes 11 and 12 are joined together outside of the coil 6, the mounting of the coil on the yoke 12 is much facilitated. In the case of the prior art pickup cartridges, the strips must be interleaved in the coils, but according to the present invention, the coil can be fitted over one leg of the laminated yoke. The one leg of the laminated yoke 12 can be inserted into the recess 11*a* of the laminated yoke or block 11. Since the contacting area between yokes 11 and 12 is sufficiently broad, the yokes 11 and 12 are fixed completely to each other. As a result, the mechanical strength of the laminated yoke 12 can be increased as compared with the case when the strips of two yokes must be interleaved to provide the same volume. In addition, the assembly can be simplified and the mechanical distortions can be minimized so that the stabilized characteristics may be ensured.

An insulation treatment, for example an oxidation, is applied on the surfaces of the yokes before the yokes are bent.

With two combinations of the laminated yoke or block 11 and the laminated yoke 12, a generator for a stereophonic pickup cartridge may be assembled as shown in FIG. 4. The inner side of the base of a right-channel yoke 12R is partially recessed as shown at 12R' while the outer side of the base of a left-channel yoke 12L is partially cut out as shown at 12L'. The yokes 12R and 12L are mounted so as to be at right angles to each other and in such a way that one end of the yokes 12R and 12L are on one vertical plane while the other ends are on another vertical plane. The coils 6L and 6R are fitted over one leg of the yokes 12L and 12R and then one end of the yokes 12L and 12R are inserted into the recesses 11*a* of the laminated yokes or blocks 11L and 11R.

Second Embodiment, FIGS. 5 through 8

Figure 5:
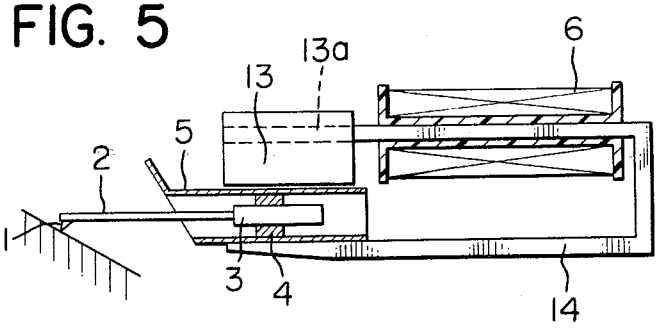
FIG. 5 is a sectional view in elevation of a second embodiment of the present invention.

The second embodiment shown in FIG. 5 is substantially similar in construction to the first embodiment shown in FIG. 3 except that each of yokes 13 and 14 consists of a pleat-like, multiple-folded sheet (See FIGS. 7 and 8) and that one end of the yoke 14 is inserted into a recess 13*a* defined in the laminated yoke or block 13 so that it may be completely surrounded with the yoke or block 13. As a result, the yoke or block 13 and the yoke 14 can be more securely joined to each other so that variations in charactertistics from one combination (consisting of the yoke or block 13 and the yoke 14) to another can be minimized. In addition, high performance can be ensured. Furthermore, the costs of the materials can be reduced, and high productivity can be ensured.

Figure 6:
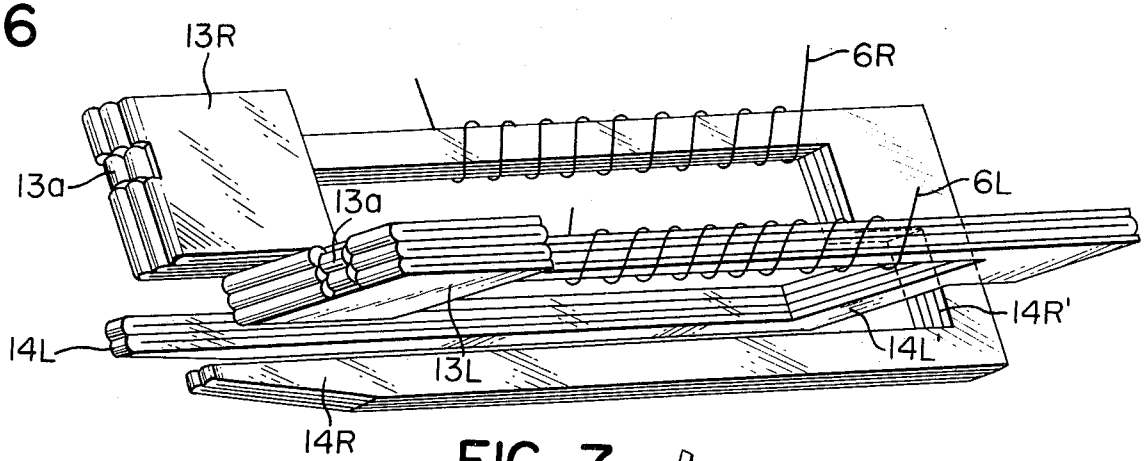
FIG. 6 shows, on enlarged scale, the generator thereof.

With two combinations of the yoke or block 13 and the yoke 14, the generator of a stereophonic pickup cartridge can be constructed as shown in FIG. 6. As with the first embodiment, the inner side of the base of the right-channel yoke 14R is partially recessed as shown at 14R' while the outer side of the base of the left-channel yoke 14L is partially cut out as indicated at 14L'. The yokes 14L and 14R are assembled at right angles to each other in such a way that the cut-out portion 14L' is placed in the recess 14R'. The coils 6L and 6R are fitted over one leg of the yokes 14L and 14R and then the legs are inserted into the recesses 13*a* of the yokes or blocks 13L and 13R.

Figure 7:
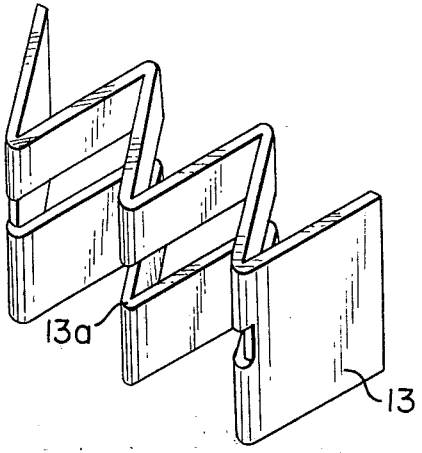
FIGS. 7 and 8 are views used for the explanation of the steps for providing the generator thereof.
Figure 8:
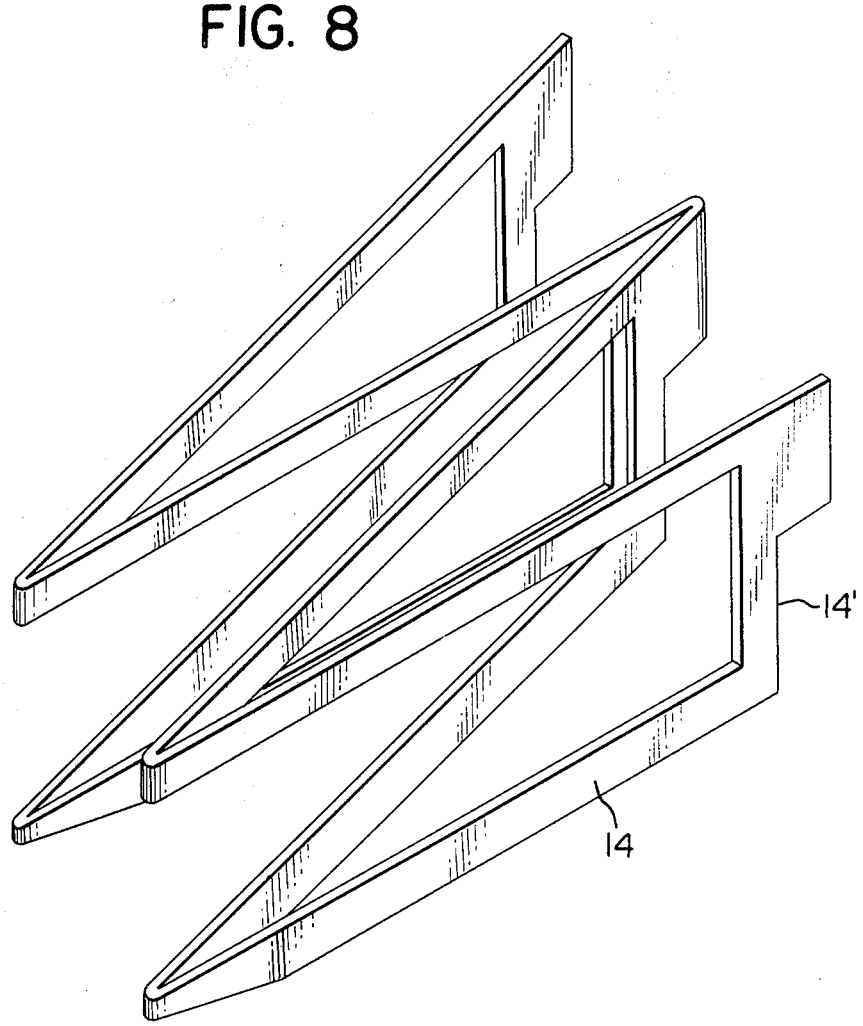

Next, referring to FIGS. 7 and 8, the method for fabricating the pleat-like, multiple folded yoke or block 13 and yoke 14 will be described. Holes are pierced by a suitable press or are etched in a metal strip, and the metal strip is folded over itself many times like pleats or laminations. Thus, the multiple folded yoke or block 13 and yoke 14 are substantially similar in construction to the laminated yoke or block 11 and laminated yoke 12 of the first embodiment. In the overlying portions the eddy currents flow in the opposite directions so that the magnetic losses mainly due to the eddy current loss can be minimized even at high frequencies. Furthermore, the second embodiment is advantageous in that the fabrication of yokes and blocks is simplified, the loss of yoke material can be minimized, and the costs can be reduced.

So far the blocks and yokes have been described as being the laminated or multiple folded ones, but it is to be understood that the yokes and blocks may be made of ferrites.

Figure 9:
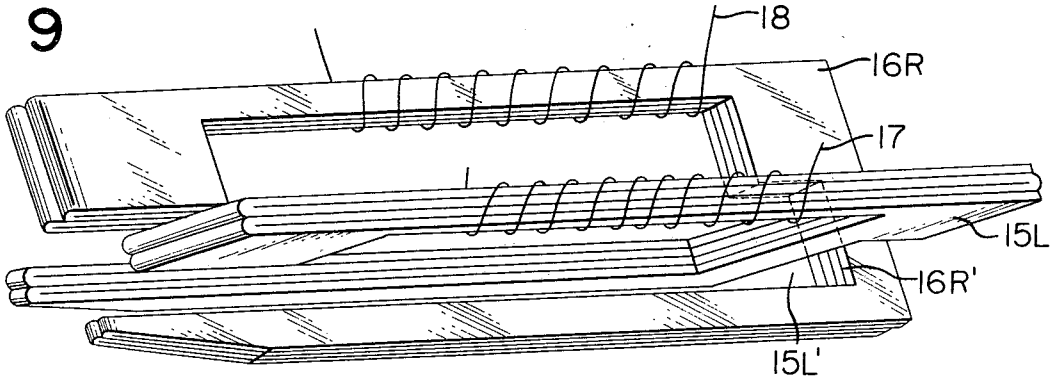
FIG. 9 is a sectional view in elevation of a third embodiment of the present invention.
Figure 11:
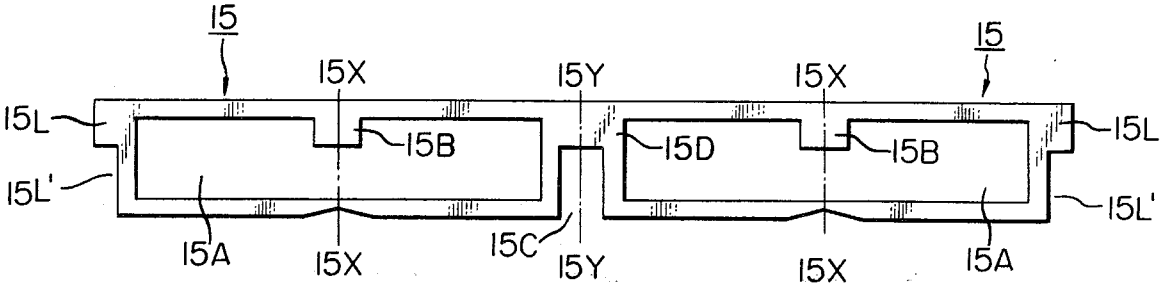
FIG. 11 is an unfolded plan view of the yoke shown in FIG. 10.
Figure 10:
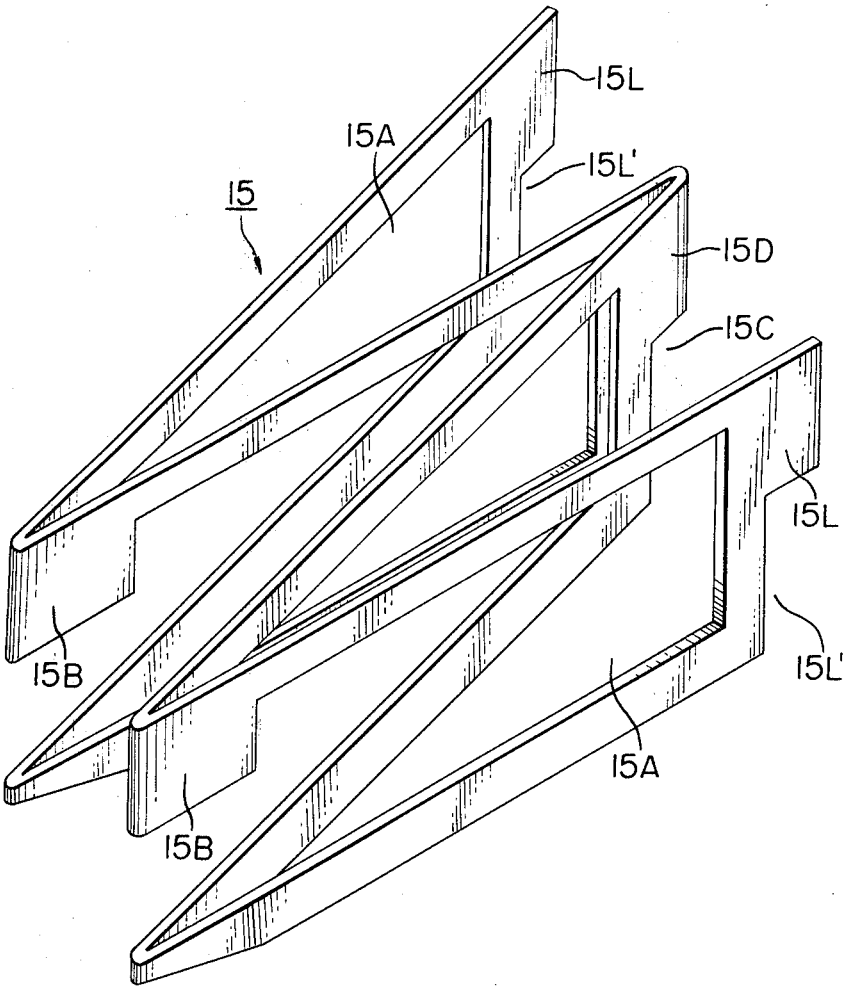
FIG. 10 is a perspective view of a yoke thereof.

Third Embodiment, FIGS. 9 through 11

The third embodiment shown in FIG. 9 is different from the first and second embodiments in that the laminated or multiple folded yoke or block 11 or 13 is eliminated; that is, a yoke 15L or 16R is formed by folding a metal strip formed by pressing or etching over itself many times like pleats. As with the first or second embodiment, the inner side of the base of the yoke 16R is partially recessed as shown at 16R' while the outer side of the base of the yoke 15L is partially cut out as shown at 15L' so that the ends of the yokes 15L and 16R are on the same vertical plane. A coil 17 or 18 can be easily wound around the leg of the yoke 15L or 16R by passing the wire between the legs whenever each turn is formed. It is obvious that the wire is wound after a bobbin is fitted over the leg or the leg has been taped so as to avoid the disconnection of the wire and the short-circuit.

The yoke 15L may be formed by the method as shown in FIGS. 10 and 11. The strip made of permalloy is formed as shown in FIG. 11 by pressing. The strip has two or four large openings 15A and two or four projections 15B projected into the openings 15A respectively for magnetic circuit through the moving magnet or moving iron. The strip is folded at lines 15X—15X and 15Y—15Y shown in FIG. 11 so that the laminated yoke 15 is formed as shown in FIG. 10. The laminated yoke 16R also may be formed in the same method as in that of the yoke 15L.

Therefore, according to the present invention, the overlapping of the yoke parts 7 and 8 of the prior art pickup cartridge as shown in FIG. 1 can be eliminated; that is, a multiple folded unitary yoke 15L or 16R is provided so that the coupling loss may be minimized. In addition, since the yoke is made of a thin metal strip, the material costs can be reduced. Furthermore, because the yoke is formed by folding the metal strip over itself many times like pleats, an automatic machine can be used so that the costs can be further reduced.

Thus, the present invention provides the high quality yokes which can also exhibit the most important feature of the laminations that the magnetic losses mainly due to the eddy current loss can be reduced to a minimum. As a result, the present invention can provide the high quality and low cost moving coil pickup cartridges with less magnetic and mechanical distortions.

What is claimed is:

1. An electromagnetic pickup cartridge comprising:

U-shaped right-channel and left-channel yokes having an open end and a base portion formed from an apertured magnetic thin strip in the form of a rectangular frame folded many times over itself;

coils mounted on said right-channel and left-channel yokes, respectively;

said right-channel and left-channel yokes with the coils being disposed along the axis of the maximum sensitivity of the right- and left-channels wherein the base portions of said right-channel and left-channel yokes cross each other, and an armature disposed within each of said right-channel and left-channel yokes adjacent to the open end thereof.

2. An electromagnetic pickup cartridge as set forth in claim 1 further comprising:

projections which extend inwardly adjacent to the folding lines of said apertured magnetic thin strip to provide magnetic spaces.

3. An electromagnetic pickup cartridge as set forth in claim 2 further comprising:

a coil wound around said projections formed on the yoke.

4. An electromagnetic pickup cartridge as set forth in claim 1 further comprising:

one of the right-channel and left-channel yokes having the inner side of the base partially recessed while the other yoke has the outer side of the base partially cut out so that the recessed portion and the cut-out portion cross each other when the right-channel and left-channel yokes are assembled.

5. An electromagnetic pickup cartridge as set forth in claim 1 wherein each of said first and second yokes comprises laminations of magnetic thin strips.

6. An electromagnetic pickup cartridge as set forth in claim 1 wherein each of said first and second yokes comprises a pleat-like multiple folded thin magnetic strip.

7. An electromagnetic pickup cartridge comprising two assemblies which respectively comprise block in the form of strip of a magnetic material and provided with a recess and a yoke in the form of U made of a magnetic material provided with a coil, one leg of of the yoke being inserted into the recess of the block, bases of the assemblies being disposed respectively along the lines which are crossed by 90° respectively with the axes of the maximum sensitivity of the right- and left-channels, and an armature placed in the space surrounded with said first and second assemblies.

* * * * *